US005490805A

United States Patent [19]

Bredesen

[11] Patent Number: 5,490,805

[45] Date of Patent: Feb. 13, 1996

[54] RETRACTABLE SURFBOARD LEASH

[76] Inventor: Carl S. Bredesen, 272 Akiohala St., Kailua, Hi. 96734

[21] Appl. No.: 322,692

[22] Filed: Oct. 13, 1994

[51] Int. Cl.[6] ..... A63C 15/06

[52] U.S. Cl. ..... 441/75; 242/371; 242/376; 242/376.1; 242/379; 242/379.2

[58] Field of Search ..... 441/75; 119/796; 242/371, 375, 376, 376.1, 379, 379.2

[56] References Cited

U.S. PATENT DOCUMENTS

| | | | |
|---|---|---|---|
| 1,576,965 | 3/1926 | Giese | 242/379.2 |
| 2,817,482 | 12/1957 | Ruggiero et al. | 242/379.2 |
| 3,012,736 | 12/1961 | Brust | 242/375 |
| 3,317,936 | 5/1967 | Johnson et al. | 242/379.2 |
| 3,912,192 | 10/1975 | Shirley | 242/379.2 |
| 4,820,220 | 4/1989 | Fruzzetti et al. | 441/74 |
| 4,938,725 | 7/1990 | Beck | 441/75 |
| 5,018,468 | 5/1991 | Peterson | 441/75 |

*Primary Examiner*—Sherman Basinger
*Attorney, Agent, or Firm*—Michael I. Kroll

[57] ABSTRACT

An improved retractable leash is provided for attaching a surfboard to a surfer. The leash consists of an elongated line with a storage unit for the line. Elements are for mounting the storage unit onto the surfboard and to allow the storage unit to rotate three hundred and sixty degrees. A component is for attaching a free end of the line to the surfer. When the surfer falls off the surfboard in any direction, the line will pull out more directly from the storage unit. A structure is for retracting the line into the storage unit, so that the slack of the line is taken up to eliminate long line drag in the water as the surfer rides the surfboard on the waves.

5 Claims, 2 Drawing Sheets

RETRACTABLE SURFBOARD LEASH

DESCRIPTION OF THE PRIOR ART

Numerous surfboard leashes have been provided in prior art. For example U.S. Pat. Nos. 3,802,011 to Castagnola; 3,931,656 to Thomson; 4,041,562 to Nealy; 4,044,415 to Wood; 4,234,990 to Colburn; 4,938,725 to Beck and Des. 303,278 to Nealy all are illustrative of such prior art. While these units may be suitable for the particular purpose to which they address, they would not be as suitable for the purposes of the present invention as heretofore described.

An ankle leash for securing a surfboard to a surfer's ankle by means of a length of resilient cord. One end of the leash cord is secured to the surfboard aft of the normal position of the surfer of the surfboard. The other cord end is attached to an ankle strap that is easily and quickly adjustable to enlarge the strap for removal over the surfer's foot in times of emergency.

A surfboard leash comprising an ankle attachment and a resilient cord attached at one end to a surfboard and at the other end to the ankle attachment. The ankle attachment includes a flexible strap having first and second ends and a buckle having at least one opening extending therethrough. One end of the strap is attached to the buckle.

The other end of the strap is adapted to be passed through the opening in the buckle, folded back on itself, and releasably attached to another region of the strap by a quick release fastener.

A surfboard leash for attaching a surfboard to a surfer, having a tubular outer element made of a resilient material such as rubber. A partially resilient inner reinforcement element is made from a material having a limited stretching ability, such as braided nylon cord. The natural length of the inner reinforcement element is several times the natural length of the outer casing, so that when unextended it lies coiled within it. The maximum stretched length of the inner reinforcement element is less than the maximum stretched length of the outer tubular casing, so that the outer casing is protected from breakage.

The invention is a leash which attaches to a surfboard at one end and to the surfer's ankle by means of a novel VELCRO sandwich-type strap structure at the other end. The leash comprising two separable sections one of which includes an elongated length of elastic tubing through which passes a length of cord which is fixed at the ends of the tubing and is coiled somewhat inside the cord such that the elastic will stretch to a certain extent until it is stopped by the cord. The other section of the leash comprising a stronger section of tubing having no cord inside to provide a resilient buffer when the slack is taken up in the line within the first tubing.

A tether line is connected between a surfboard and an ankle cuff about a surfer's ankle, so that the surfer will not lose the surfboard if he becomes separated from the board. A quick release is provided between the one end of the tether line and the ankle cuff permitting the surfer to manually release the tether line from the ankle cuff in an emergency situation. The quick release includes a yoke member to which the tether line is secured, arranged to straddle an opening in the ankle cuff. A pin passes through the arms of the fork and the opening in the cuff and by simply manually removing the pin, the quick release results.

A leash including a cord to attach a surfer to his surfboard. The cord is retractable by spring action into a housing, so as to eliminate slack or excess cord length and thereby reduce both the potential for tangling and drag through the water. The housing is detachably connected to the surfboard at the existing crossbar which is typically embedded therewithin.

The ornamental design for a surfboard leash strap, as shown and described.

FIG. 8 is an enlarged fragmentary outer side elevational view of a fifth embodiment of the surfboard leash strap showing diamond configuration openings in the strap.

FIG. 9 is an enlarged fragmentary outer side elevational view of a sixth embodiment of the surfboard leash strap showing star configuration openings in the strap.

Figure 1:
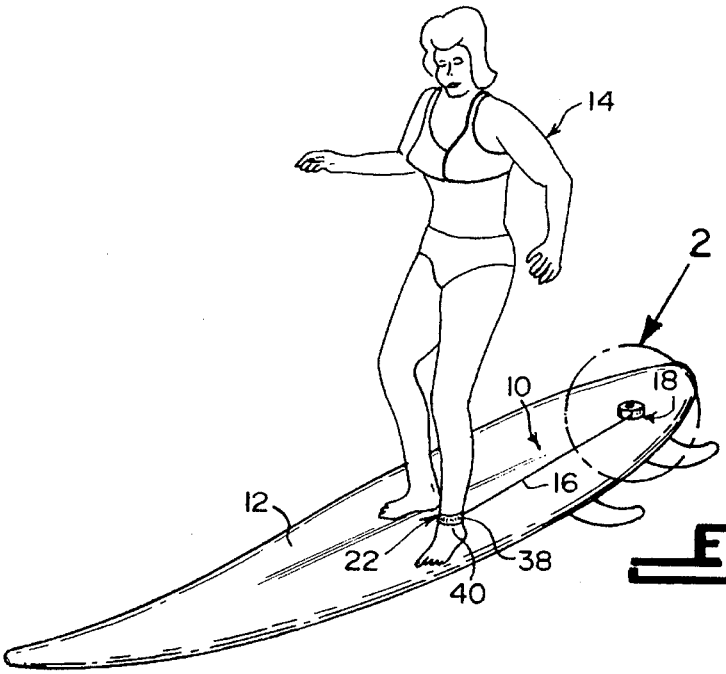
FIG. 1 is a perspective view of a surfboard leash strap showing the new design.

The sole difference among the first, second (FIG. 5), third (FIG. 6), fourth (FIG. 7), fifth (FIG. 8) and sixth (FIG. 9) embodiments being in the different configuration of the openings in the straps.

SUMMARY OF THE INVENTION

A first object of the present invention is to provide an improved retractable surfboard leash that will overcome the shortcomings of the prior art devices.

A second object is to provide an improved retractable surfboard leash, in which the slack of a line is retained by spring action within a housing mounted onto a surfboard, so as to eliminate long line drag in the water as a surfer rides the waves.

A third object is to provide an improved retractable surfboard leash, in which the line will not bind when extensive force is applied by large waves.

A fourth object is to provide an improved retractable surfboard leash in which the line can rotate three hundred and sixty degrees, so that whatever direction the surfer falls the line can be quickly extended from the housing to a proper length to be connected by a cuff to the ankle of the surfer in a safe manner.

A fifth object is to provide an improved retractable surfboard leash, in which the leash is stored within the housing, so as to eliminate the hazards of tangling and to provide a safer system for the surfer.

A sixth object is to provide an improved retractable surfboard leash, whereby the surfer can change the line without any interference with the return spring system for the safety of consumer use.

A seventh object is to provide an improved retractable surfboard leash, in which the perforated top surface of the housing makes the unit ecology safe, since there is no need to use grease to operate the return spring and to lubricate the line, thereby keeping the ocean clean.

An eighth object is to provide an improved retractable surfboard leash that is simple and easy to use.

A ninth object is to provide an improved surfboard leash that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view showing the instant invention in use on a surfboard.

Figure 2:
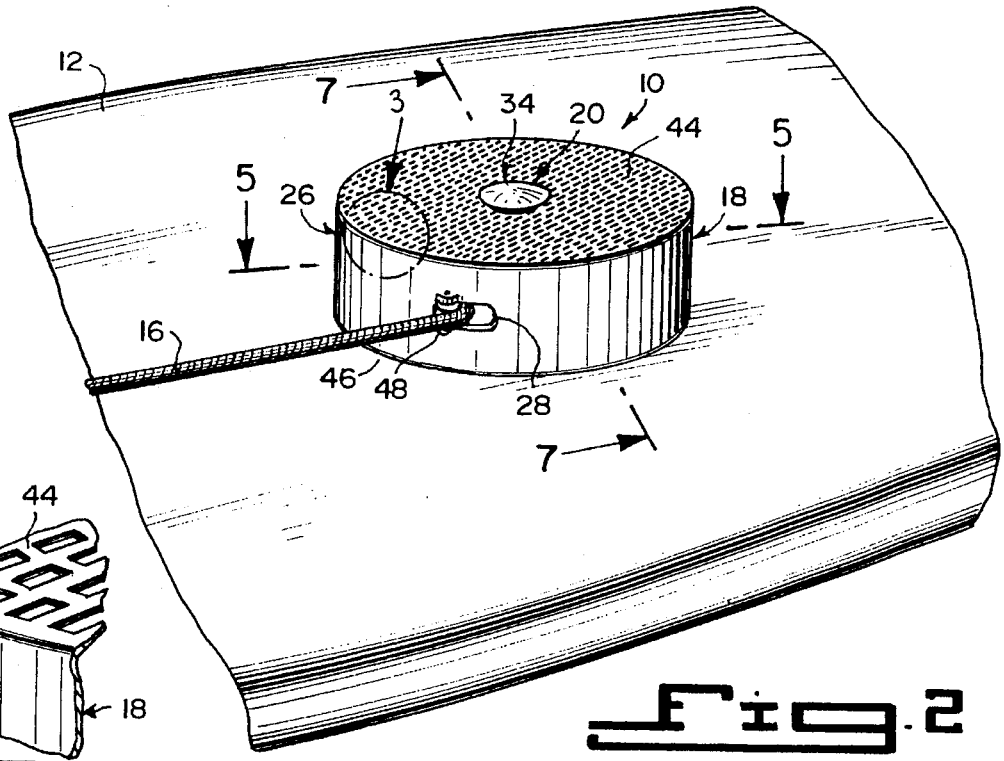
FIG. 2 is an outer side elevational view thereof, showing the strap in fully open condition.

FIG. 2 is an enlarged perspective view of a portion thereof as indicated by arrow 2 in FIG. 1.

Figure 3:
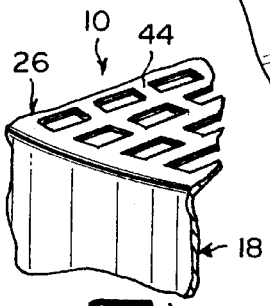
FIG. 3 is a top plan view of FIG. 2.

FIG. 3 is a further enlarged perspective view of a portion thereof as indicated by arrow 3 in FIG. 2.

Figure 4:
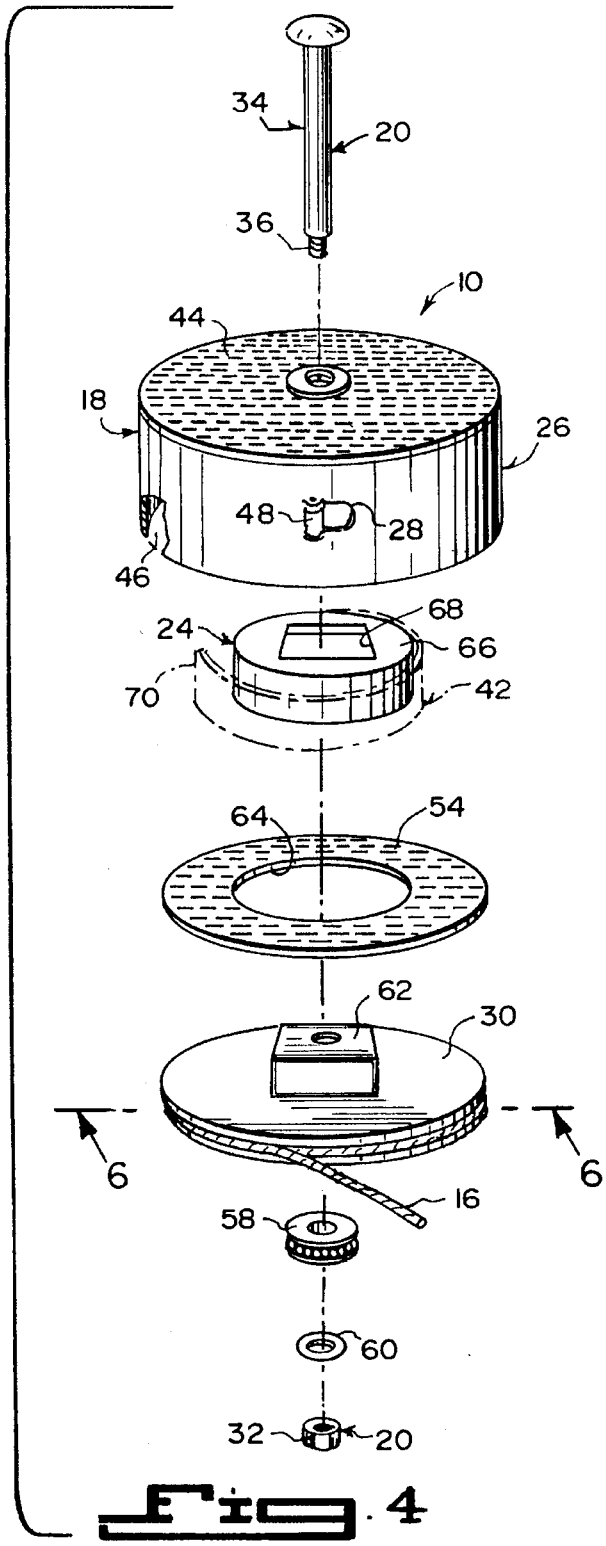
FIG. 4 is an inner side elevational view of FIG. 2.

FIG. 4 is an exploded perspective view of the line storage unit showing the various components therein.

Figure 5:
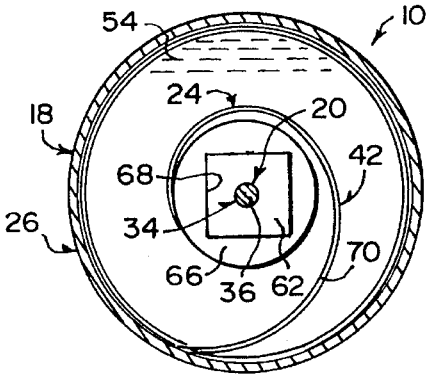
FIG. 5 is an enlarged fragmentary outer side elevational view of a second embodiment of the surfboard leash strap showing rectangular openings in the strap.

FIG. 5 is a cross sectional view taken along line 5—5 in FIG. 2, of just the line storage unit per se, showing the spiral return spring that extends between the cap and the housing.

Figure 6:
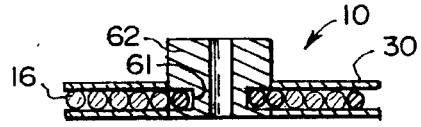
FIG. 6 is an enlarged fragmentary outer side elevational view of a third embodiment of the surfboard leash strap showing hexagonal openings in the strap.

FIG. 6 is a cross sectional view taken along line 6—6 in FIG. 4 through the spool.

Figure 7:
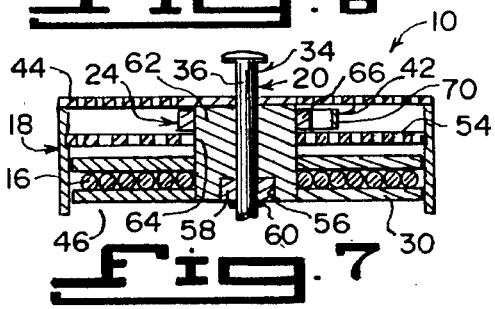
FIG. 7 is an enlarged fragmentary outer side elevational view of a fourth embodiment of the surfboard leash strap showing triangular openings in the strap.

FIG. 7 is a cross sectional view taken along the line 7—7 in FIG. 2 just through the line storage unit per se.

DETAILED DESCRIPTION OF THE PREFERRED EMBODIMENTS

Turning now descriptively to the drawings, in which similar reference characters denote similar elements throughout the several views, FIGS. 1 through 7 illustrate an improved retractable leash 10 for attaching a surfboard 12 to a surfer 14. The leash 10 consists of an elongated line 16, with a storage unit 18 for the line 16. Elements 20 are for mounting the storage unit 18 onto the surfboard 12 and to allow the storage unit 18 to rotate three hundred and sixty degrees. A component 22 is for attaching a free end of the line 16 to the surfer. When the surfer 14 falls off the surfboard 12 in any direction, the line 16 will pull out more directly from the storage unit 18. A structure 24 is for retracting the line 16 into the storage unit 18, so that the slack of the line 16 is taken up to eliminate long line drag in the water as the surfer 14 rides the surfboard 12 on the wave.

The storage unit 18 includes a housing 26, having a side aperture 28. A spool 30 is rotatively carried within the housing 26, to allow the line 16 to pass through the aperture 28 in the housing 26 and wrap about the spool 30.

The mounting elements 20 consists of an anchor nut 32 embedded into a top surface of the surfboard 12. A bolt 34 has a threaded shank 36, which extends centrally through the housing 26, through the spool 30 and threadably engages with the anchor nut 32, thereby allowing the housing 26 to rotate three hundred and sixty degrees. The attaching component 22 is a cuff 38, which fits about an ankle 40 of the surfer 14.

The retracting structure 24 is a spring biasing assembly 42 coupled between the housing 26 and the spool 30, so as to cause rotation of the spool 30 within the housing 26, to normally pull the line 16 back upon the spool 30. The housing 26 is cylindrical shaped, having a perforated top surface 44 and an opened bottom 46 to allow water to enter therein and exit therefrom to lubricate the spool 30.

A roller 48 is located at the side aperture 28 of the housing 26. The line 16 can be pulled through the side aperture 28 on the roller 48, to prevent binding of the line 16.

A perforated plate 54 is made to be secured about the spring biasing assembly 42 and the housing 26, to allow water to exit therefrom. The spool 30 has a bottom central recess 56 therein. A bearing 58 fits into the bottom central recess 56 about the shank 36 of the bolt 34. A small rubber ring seal washer 60 sits between the bearing 58 and the anchor nut 32 in the surfboard 12. The spool 30 has a side recess area 61, for tying off a new line 16, as shown in FIG. 6.

The spool 30 has a box-shaped member 62 centrally positioned and extending upwardly therefrom. The perforated plate 54 has a large aperture 64 therethrough, so as to fit over the box-shaped member 62. The spring biasing assembly 42 has a cap 66 with a box-shaped opening 68 to fit over the box-shaped member 62. A spiral return spring 70 extends between the cap 66 and an inner side of the housing 18.

OPERATION OF THE INVENTION

To use the improved retractable leash 10, the following steps should be taken:

1. Form a cavity within a top surface of the surfboard 12.
2. Glue the anchor nut 32 within the cavity.
3. Place the bearing 58 into the bottom central recess in the spool 30.
4. Insert the line 16 from the outside through the aperture 28 in the housing 18 and into the spool 30.
5. Tie off the line 16 inside at the side recess area 61 within the spool 30.
6. Insert the spool 30 into the cap 66. The return spring 70, cap 66 and perforated plate 54 are pre-fitted.
7. Put the cap 66 with the box-shaped opening 68 onto the box-shaped member 62 on the spool 30.
8. Insert the shank 36 of the bolt 34 through the housing 26, the spool 30, past the bearing 58.
9. Slide the small rubber ring seal 60 onto the shank 36 of the bolt 34.
10. Thread the shank 36 into the anchor nut 32 and tighten.
11. Pull the line 16 out from the side aperture 28 in the housing 26.
12. Connect the cuff 38 to the ankle 40 of the surfer 14.

LIST OF REFERENCE NUMBERS

10 improved retractable leash
12 surfboard
14 surfer
16 elongated line
18 storage unit for 16
20 mounting elements
22 attaching component to 14
24 retracting structure
26 housing
28 side aperture in 26

30 spool
32 anchor nut
34 bolt
36 threaded shank of 34
38 cuff for 22
40 ankle of 14
42 spring biasing assembly
44 perforated top,surface of 26
46 open bottom of 26
48 roller at 28
54 perforated plate
56 bottom central recess in 30
58 bearing
60 small rubber ring seal washer
61 side recess area in 30
62 box-shaped member on 30
64 large aperture in 54
66 cap
68 box-shaped opening in 66
70 spiral return spring on 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved retractable leash for attaching a surfboard to a surfer, said leash comprising:

a) an elongated line;

b) a storage unit for said line, said storage unit including a housing having a side aperture, and a spool rotatively carried within said housing to allow said line to pass through said aperture in said housing and wrap about said spool;

c) means for mounting said storage unit onto the surfboard and allowing said storage unit to rotate three hundred and sixty degrees, said mounting means including an anchor nut embedded into a top surface of said surfboard, and a bolt having a threaded shank which extends centrally through said housing, through said spool and threadably engages with said anchor nut, thereby allowing said housing to rotate three hundred and sixty degrees;

d) means for attaching a free end of said line to the surfer, so that when the surfer falls off the surfboard in any direction said line will pull out more directly from said storage unit, said attaching means is a cuff which fits about an ankle of the surfer; and e) means for retracting said line into said storage unit, so that the slack of said line is taken up to eliminate long line drag in the water as the surfer rides the surfboard on the waves, said retracting means including a spring biasing assembly coupled between said housing and said spool, so as to cause rotation of said spool within said housing to normally pull said line back upon said spool, said housing being cylindrical shaped having a perforated top surface and an opened bottom to allow water to enter therein and exit therefrom to lubricate said spool.

2. An improved retractable leash as recited in claim 1, wherein said storage unit further includes a roller located at said side aperture of said housing, so that said line can be pulled through said side aperture on said roller to prevent binding of said line.

3. An improved retractable leash as recited in claim 2, wherein said storage unit further includes a perforated plate which is made to be secured about said spring biasing assembly and said housing, to allow water to exit therefrom.

4. An improved retractable leash as recited in claim 3, wherein said storage unit further includes:

a) said spool having a bottom central recess therein;

b) a bearing to fit into said bottom central recess about said shank of said bolt; and c) a small rubber ring seal washer to sit between said bearing and said anchor nut in the surfboard; and d) said spool having a side recess area for tying off a new line.

5. An improved retractable leash as recited in claim 4, further including:

a) said spool having a box-shaped member centrally positioned and extending upwardly therefrom;

b) said perforated plate having a large aperture therethrough, so as to fit over said box-shaped member; and c) said spring biasing assembly having a cap with a box-shaped opening to fit over said box-shaped member and a spiral return spring extending between said cap and an inner side of said housing.

* * * * *